United States Patent [19]

Stahlecker

[11] Patent Number: 4,967,547

[45] Date of Patent: Nov. 6, 1990

[54] DRAFTING UNIT FOR A SPINNING MACHINE

[75] Inventor: Fritz Stahlecker, Bad Überkingen, Fed. Rep. of Germany

[73] Assignee: Fritz and Hans Stahlecker, Fed. Rep. of Germany

[21] Appl. No.: 379,646

[22] Filed: Jul. 14, 1989

[30] Foreign Application Priority Data

Jul. 23, 1988 [DE] Fed. Rep. of Germany ..... 3825068

[51] Int. Cl.[5] ..... D01H 1/115; D01H 5/28; D01H 5/26

[52] U.S. Cl. ..... 57/328.000; 19/244; 57/315

[58] Field of Search ..... 19/244–256; 57/315, 328, 316–318, 331

[56] References Cited

U.S. PATENT DOCUMENTS

| | | | |
|---|---|---|---|
| 2,484,810 | 10/1949 | Bacon et al. | 19/244 X |
| 2,955,329 | 10/1960 | Noda | 19/244 X |
| 3,011,221 | 12/1961 | Howell | 19/244 |
| 4,296,528 | 10/1981 | Shlykov et al. | 19/255 |
| 4,384,448 | 5/1983 | Wilkie | 57/328 X |
| 4,498,216 | 2/1985 | Suzuki et al. | 19/244 |
| 4,551,887 | 11/1985 | Uematsu | 19/244 |
| 4,680,833 | 7/1987 | Bahov et al. | 19/244 |
| 4,718,225 | 1/1988 | Sanagi | 47/328 |
| 4,727,626 | 3/1988 | Vinas | 57/315 X |

FOREIGN PATENT DOCUMENTS

| | | |
|---|---|---|
| 0107828 | 5/1984 | European Pat. Off. . |
| 3319559 | 12/1983 | Fed. Rep. of Germany . |

*Primary Examiner*—John Petrakes

*Attorney, Agent, or Firm*—Evenson, Wands, Edwards, Lenahan & McKeown

[57] ABSTRACT

In the case of a drafting unit for a spinning machine having a drafting zone, which is delimited by two pairs of rollers each consisting of top rollers and bottom rollers and in which an apron guide is located, it is provided that the diameter of at least the bottom roller of the following pair of rollers is smaller than the diameter of the bottom roller of the preceding pair of rollers.

16 Claims, 1 Drawing Sheet

Fig. 1
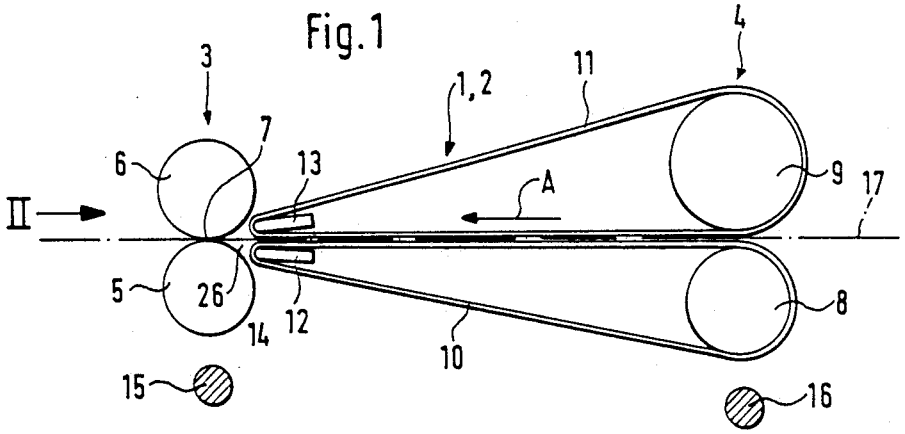
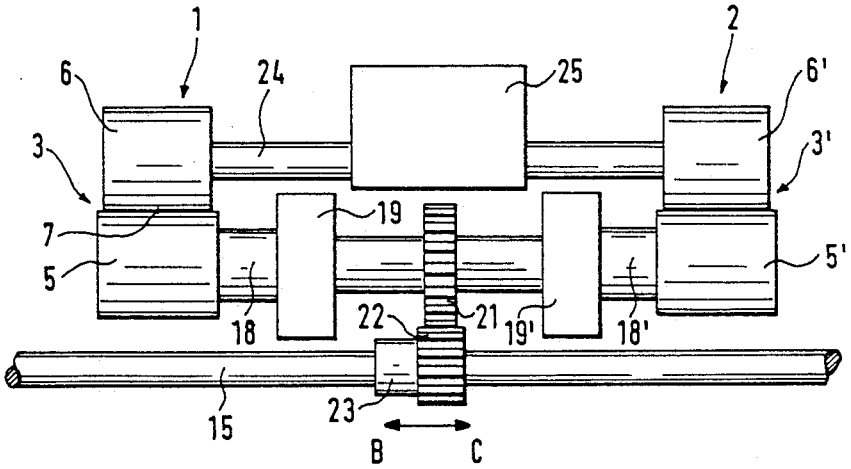
Fig. 2

DRAFTING UNIT FOR A SPINNING MACHINE

BACKGROUND AND SUMMARY OF THE INVENTION

The invention relates to a drafting unit for a spinning machine having a drafting zone delimited by two pairs of rollers, which are each formed of top rollers and bottom rollers, an apron guide having top aprons and bottom aprons being located in this drafting zone, the top apron being wound around the top roller and the bottom apron being wound around the bottom roller of the preceding pair of rollers, and the aprons, in each case, being guided around reflecting guides in proximity of the nip line of the following pair of rollers.

Drafting units of the initially mentioned type are used in spinning machines of a variety of types, particularly in ring spinning machines. With respect to their construction, a basic rule has developed according to which it is provided that the diameters of all rollers are maintained to be essentially identical.

In modern spinning machines and particularly in new technologies, such as pneumatic false-twist spinning or the only pneumatic prestrengthening of yarn components which are to be later twisted together, significantly higher working speeds are obtained than during ring spinning, so that the working conditions of the drafting units change also. It was found, for example (EP-B No. 01 07 828) that the air currents generated by the top and bottom rollers running at high circumferential speeds interfere with the order of fibers in the sliver. It is therefore provided in this construction that the top aprons and the bottom aprons, in the area not carrying any fibers, are guided as closely as possible to the circumference of the top rollers and the bottom rollers, so that the air currents are deflected already in front of the area of the nip line in axial direction of the rollers and cannot interfere with the order of the fibers.

An object of the invention is to provide a drafting unit of the initially mentioned type which, in particular, is suitable for the processing of short-staple fiber material at high speeds.

This object is achieved according to preferred embodiments of the invention by providing that the diameter of at least the bottom roller of the following pair of rollers is smaller than the diameter of the bottom roller of the preceding pair of rollers.

By means of this construction, it is achieved that the distance can be reduced of the nip area between the top apron and the bottom apron from the nip line of the following pair of rollers which, as a rule, will be the pair of delivery rollers. Thus, the area is shortened in which the fibers are not guided. In addition, it is achieved by means of the reduction of the diameter that the air current caused by the respective roller is reduced, the strength of this air current depending on the diameter.

In a further development of preferred embodiments of the invention, it is provided that the bottom roller of the following pair of rollers is constructed as an overmounted shaft piece which is connected to a drive. By means of this construction, which is known in principle from German Published Examined Application (DE-A) No. 33 19 559, it is possible to fix the diameter irrespective of the normal restrictions. Specifically, in the previous constructions, in which the bottom roller was constructed as a cylinder (composed of several parts) extending through in longitudinal direction of the machine, it was not possible to fall below a certain diameter. The reason is that care had to be taken that the occurring torsional tensions would not result in excessive torsional deformations. By means of the division into individual shaft pieces, it is possible to clearly differentiate and make the effective diameter smaller than the previous minimum diameter of approximately 25 mm, without the occurrence of excessive torsional strains.

The pair of rollers which, in the context of the present invention, is called the "following pair of rollers", will, as a rule, be the pair of delivery rollers. However, embodiments are also contemplated wherein several drafting zones are provided which contain apron guides and which are then each delimited by a pair of rollers. In order to be able to move the fiber carrying area of these apron guides as closely as possible to the nip line of the following pair of rollers, corresponding adaptations of diameter may be carried out.

Other objects, advantages and novel features of the present invention will become apparent from the following detailed description of the invention when considered in conjunction with the accompanying drawings.

BRIEF DESCRIPTION OF THE DRAWINGS

FIG. 1 is a largely schematic representation of a lateral view of a drafting unit in the area of the drafting zone containing an apron guide, this drafting zone being delimited by a preceding pair of rollers and a pair of delivery rollers, constructed according to a preferred embodiment of the invention; and FIG. 2 is a view of the drafting unit in the direction of arrow II of FIG. 1.

DETAILED DESCRIPTION OF THE DRAWINGS

In the embodiment shown in FIGS. 1 and 2, two drafting units 1, 2 are combined to form a structural unit. A spinning machine contains a plurality of such structural units which are arranged in a row extending in longitudinal direction of the machine. This combining of two drafting units 1, 2 to form a structural unit is particularly advantageous if, as in the shown embodiment, these two drafting units 1, 2 are used for simultaneously drafting two slivers 17 which pass through the drafting units 1, 2 in direction A, after which the two drafted slivers 17 are prestrengthened by means of pneumatic false-twist spinning and are wound as a double yarn onto a package. This package with the double yarns will be used later as a feeding package for a twisting. The structural unit consisting of two drafting units 1, 2, which will be described in detail in the following, is particularly suitable for this type of a machine because, on the one hand, short-staple fiber material is also used here, while, on the other hand, the working speeds are extremely high. Only the drafting unit 1 will be described in detail below. Drafting unit 2, which is arranged mirror-symmetrically with respect to drafting unit 1, basically has the same construction.

Drafting unit 1, which contains at least one pair of draw-in rollers, which is not shown, contains a drafting zone, which is delimited by a pair of rollers 4, which is disposed in front in travel direction A, and by a pair of rollers 3 which follows, i.e., the so-called pair of delivery rollers. The pairs of rollers 3, 4 each consist of bottom rollers 5, 8 and top rollers 6, 9. The bottom rollers 5, 8 are driven, as will be explained in detail in the following. The top rollers 6, 6'; 9, 9' are developed as so-called pressure roller twins 6, 6'; 9, 9' and are held by a carrying and weighting arm 25. The top rollers 6, 6'; 9, 9' are, in each case, arranged on a common shaft, as shown for the top rollers 6, 6' of the pair 3 of delivery rollers by means of shaft 24.

The bottom rollers 5, 5' are constructed as shaft sections 18, 18', which are disposed in bearings 19, 19'. The shaft sections 18, 18' are non-rotatably connected with a common toothed wheel 21 arranged in the center, which meshes with a toothed wheel 22, which is arranged on a shaft 15 which extends through in longitudinal direction of the machine and, as a rule, is composed of several partial sections. This toothed wheel 22, by means of a shiftable clutch 23, is connected with the shaft 15, the clutch 23 being constructed, for example, in such a manner that by means of it, the toothed wheel 22 can be pushed in the direction of the arrows (B and C), and thus can be engaged with and disengaged from the toothed wheel 21. The clutch 23, in a manner not shown in detail, is controlled electrically, particularly by means of a yarn detector, which responds to a breakage of the prestrengthened yarn components, which are formed from the slivers 17.

As shown in FIG. 2, toothed wheel 22 has a smaller diameter than toothed wheel 21; i.e., the shaft 15 runs at a relatively high rotational speed and is therefore less endangered with respect to torsional deformations.

As shown in FIG. 1 by means of the shaft 16 extending through in longitudinal direction of the machine, the remaining bottom rollers 8 of the drafting units 1, 2 may also be constructed correspondingly as shaft sections which are driven individually.

An apron guide is disposed in the drafting zone between the two pairs of rollers 3, 4. This apron guide contains a top apron 11, which is wound around the top roller 9 and is guided around a deflecting guide 13. In a corresponding manner, a bottom apron 10 is wound around the bottom roller 8 and guided around a deflecting guide 12. The deflecting guides 12, 13 with the end 14 of the guide zone of the apron guide are moved as closely as possible to the nip line 7 of the pair of delivery rollers 3. The slivers 17 are therefore exposed only in the area of the wedge-shaped gap 26 of the pair of delivery rollers 3 over a relatively short section. As shown in FIG. 1 and 2, the bottom roller 5 and the top roller 6 of the pair of delivery rollers 3 in their diameter are clearly smaller than the bottom roller 8 of the preceding pair of rollers 4. As a result, it is made possible, on the one hand, to move the end 14 of the nip area of the apron guides 10, 11 relatively closely to the nip line 7 of the pair of delivery rollers 3, while, on the other hand, the air currents generated by the pair of delivery rollers 3 are reduced.

In principle, it is also contemplated to arrange the same dimensioning of a preceding and following pair of rollers also in a drafting zone which precedes the shown drafting zone in front of the pair of delivery rollers 3. However, in the majority of cases, this will not be necessary because the roller pairs located in this area run at a markedly lower speed. The highest speed exists in the area of the pair of delivery rollers 3.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drafting unit for a spinning machine having a drafting zone delimited by first and second pairs of rollers, which are each formed of respective first and second top and bottom rollers, an apron guide having top and bottom aprons being located in this drafting zone, the top apron being wound around the first top roller and the bottom apron being wound around the first bottom roller, said aprons being guided around deflecting guides in each case in proximity of a nip line of the second pair of rollers, wherein the bottom roller and the top roller of the second pair of rollers have essentially the same diameter, which diameter is less than 25 mm and smaller than the diameter of the first bottom apron roller, thereby accommodating placement of the apron deflecting guides closer to the nip line of the following pair of rollers to enhance the guidance of sliver to the nip line.

2. A drafting unit according to claim 1, wherein said second pair of rollers is a pair of delivery rollers which delivers the drafted sliver to a spinning unit.

3. A drafting unit according to claim 2, wherein said spinning unit includes pneumatic prestrengthening nozzle means for receiving the drafted sliver from the pair of delivery rollers.

4. A drafting unit according to one of claim 1, wherein the bottom roller of the second pair of rollers is constructed as an over-mounted shaft piece which is connected to a drive.

5. A drafting unit according to claim 4, wherein the bottom rollers of the second pairs of rollers of two adjacent drafting units are constructed as a shaft piece.

6. A drafting unit according claim 5, wherein the shaft piece is connected by means of transmission devices containing a clutch connected to a continuous, centrally driven shaft.

7. A drafting unit according to claim 6, wherein the transmission devices contain a pair of toothed wheels of different diameters, of which the wheel with the smaller diameter is assigned to the centrally driven shaft and the wheel with the larger diameter is assigned to the shaft piece forming the bottom rollers.

8. A drafting unit according to claim 1, wherein the bottom rollers of the second pairs of rollers of two adjacent drafting units are constructed as a shaft piece.

9. A drafting unit according to claim 8, wherein the shaft piece is connected by means of transmission devices containing a clutch connected to a continuous, centrally driven shaft.

10. A drafting unit according to claim 9, wherein the transmission devices contain a pair of toothed wheels of different diameters, of which the wheel with the smaller diameter is assigned to the centrally driven shaft and the wheel with the larger diameter is assigned to the shaft piece forming the bottom rollers.

11. A drafting unit according to claim 10, wherein said spinning machine is a pneumatic prestrengthening machine including a pair of prestrengthening nozzles downstream of the drafting unit for prestrengthening two parallelly arranged slivers drafted in drafting zones of the drafting unit.

12. A drafting unit according to claim 8, wherein said spinning machine is a pneumatic prestrengthening machine including a pair of prestrengthening nozzles downstream of the drafting unit for prestrengthening two parallelly arranged slivers drafted in drafting zones of the drafting unit.

13. A drafting unit according to claim 12, wherein said second pair of rollers is a pair of delivery rollers which delivers the drafted sliver to a spinning unit.

14. A drafting unit according to claim 1, wherein said spinning machine is a pneumatic prestrengthening machine including a pair of prestrengthening nozzles downstream of the drafting unit for prestrengthening two parallelly arranged slivers drafted in drafting zones of the drafting unit.

15. A drafting unit according to claim 1, wherein said second pair of rollers is a pair of delivery rollers which delivers the drafted sliver to a spinning unit.

16. A drafting unit according to claim 15, wherein said spinning unit includes pneumatic prestrengthening nozzle means for receiving the drafted sliver from the pair of delivery rollers.

* * * * *